US009457255B1

(12) United States Patent
Fitzgerald

(10) Patent No.: US 9,457,255 B1
(45) Date of Patent: Oct. 4, 2016

(54) SHIN SAVER DEVICE

(71) Applicant: Bradley Fitzgerald, Falkville, AL (US)

(72) Inventor: Bradley Fitzgerald, Falkville, AL (US)

( * ) Notice: Subject to any disclaimer, the term of this patent is extended or adjusted under 35 U.S.C. 154(b) by 0 days.

(21) Appl. No.: 14/698,591

(22) Filed: Apr. 28, 2015

(51) Int. Cl.
*A63B 71/00* (2006.01)
*A63B 67/00* (2006.01)

(52) U.S. Cl.
CPC ..... *A63B 71/0054* (2013.01); *A63B 67/002* (2013.01); *A63B 2071/0072* (2013.01)

(58) Field of Classification Search
CPC ..... A63B 71/1225; A41D 17/00; A41D 13/0518; A41D 13/0531; A41D 13/0568; F41H 1/02; F41H 3/00; F41H 5/0492; F41H 5/088; F41H 5/12
USPC ..... 2/22, 242, 2.5, 463, 467; 89/36.01, 89/36.02, 36.05, 36.06
See application file for complete search history.

(56) References Cited

U.S. PATENT DOCUMENTS 4,344,189 A * 8/1982 Futere ..... A41D 13/08 2/16
4,765,617 A 8/1988 Groves
5,031,607 A * 7/1991 Peters ..... A43B 7/20 2/22
5,301,370 A * 4/1994 Henson ..... A63B 71/1225 2/22
6,354,968 B1 3/2002 Nozato
6,955,615 B1 10/2005 Cavell
7,153,225 B2 12/2006 Morrow
7,216,664 B2 * 5/2007 Ortner et al. ..... 137/172
7,243,590 B2 * 7/2007 McClellan et al. ..... 89/36.06
7,341,314 B1 3/2008 Boyd
7,462,115 B2 12/2008 Morrow
7,594,515 B2 * 9/2009 Prock ..... 135/117
7,716,748 B2 * 5/2010 Dovner ..... 2/2.5
7,866,106 B2 * 1/2011 Bowlware ..... 52/424
8,388,471 B2 3/2013 Morrow
8,651,981 B2 2/2014 Morrow
2006/0089213 A1 4/2006 Snyder
2007/0049428 A1 3/2007 Stromsborg
2009/0098956 A1 4/2009 Morrow
2011/0195804 A1 8/2011 Hixon et al.
2014/0201970 A1 7/2014 Morrow
2014/0335977 A1 11/2014 Baranek

* cited by examiner

*Primary Examiner* — Tejash Patel
(74) *Attorney, Agent, or Firm* — Paul Sykes; Bradley Arant Boult Cummings LLP

(57) ABSTRACT

A sporting good device for protecting the lower body from ball strikes while catching warm-up pitches from a seated position. The device comprises one or more generally upright panels and a footplate or other structure designed to accommodate the user's feet. When the user is seated behind the device, and the feet engage the footplate or other structure, the device is at least partially stabilized in the upright position.

9 Claims, 7 Drawing Sheets

SHIN SAVER DEVICE

TECHNICAL FIELD

This disclosure relates generally to protective athletic equipment.

BACKGROUND

During baseball or fast-pitch softball games, it is necessary for a pitcher to warm up by throwing a series of practice pitches. Generally, during youth baseball or softball, the coach or other assistant will warm up the pitchers from a seated position, often on a bucket. Difficulties may arise when pitches go astray, striking the coach. Such pitches have the risk of causing injury, generally to the front portion of the coach based upon the front-facing seated position. The ball may strike the shins, knees, or groin of the seated coach. Thus, it is desirable to have a protective device to shield the body from pitches gone awry.

Some pitches may go astray, passing the coach and requiring him to stand from the seated position to fetch the ball. Therefore, it is desirable that it is easy for the coach to extricate himself from the device. It may be desirable that the device be free-standing so that it remains in the correct position while the coach is away fetching the ball, and he can quickly and easily resume his protected seated position upon his return with the ball.

Because baseball and softball practices occur at different locations, a protective device that is readily transportable may be preferable.

SUMMARY

Embodiments of the present invention satisfy these needs, but it should be noted that not all embodiments may satisfy each need. One embodiment comprises a protective sporting good device, comprising a panel having a front surface and a rear surface and an upper portion and a lower portion and a lower edge and an upper edge and an inner edge and an outer edge, and a foot plate positioned near the lower edge adapted for receiving a user's foot, wherein while in use, the device may be stabilized in a substantially upright orientation at least partially by the user placing his foot on the foot plate.

Another embodiment comprises a protective sporting good device, comprising a panel having a front surface and a rear surface and an upper portion and a lower portion and a lower edge and an upper edge and an inner edge and an outer edge, and a means for receiving the feet of an individual, wherein engagement of the individual's feet with said means at least partially stabilizes the device in an upright position.

Another embodiment comprises a protective sporting good device, comprising a panel having a front surface and a rear surface and an upper portion and a lower portion and a lower edge and an upper edge and an inner edge and an outer edge, and an arched opening located at the lower edge of the panel, and a foot plate extending across said arched opening.

BRIEF DESCRIPTION OF THE DRAWINGS

The present invention will be explained, by way of example only, with reference to certain embodiments and the attached figures, in which.

DETAILED DESCRIPTION

Figure 1:
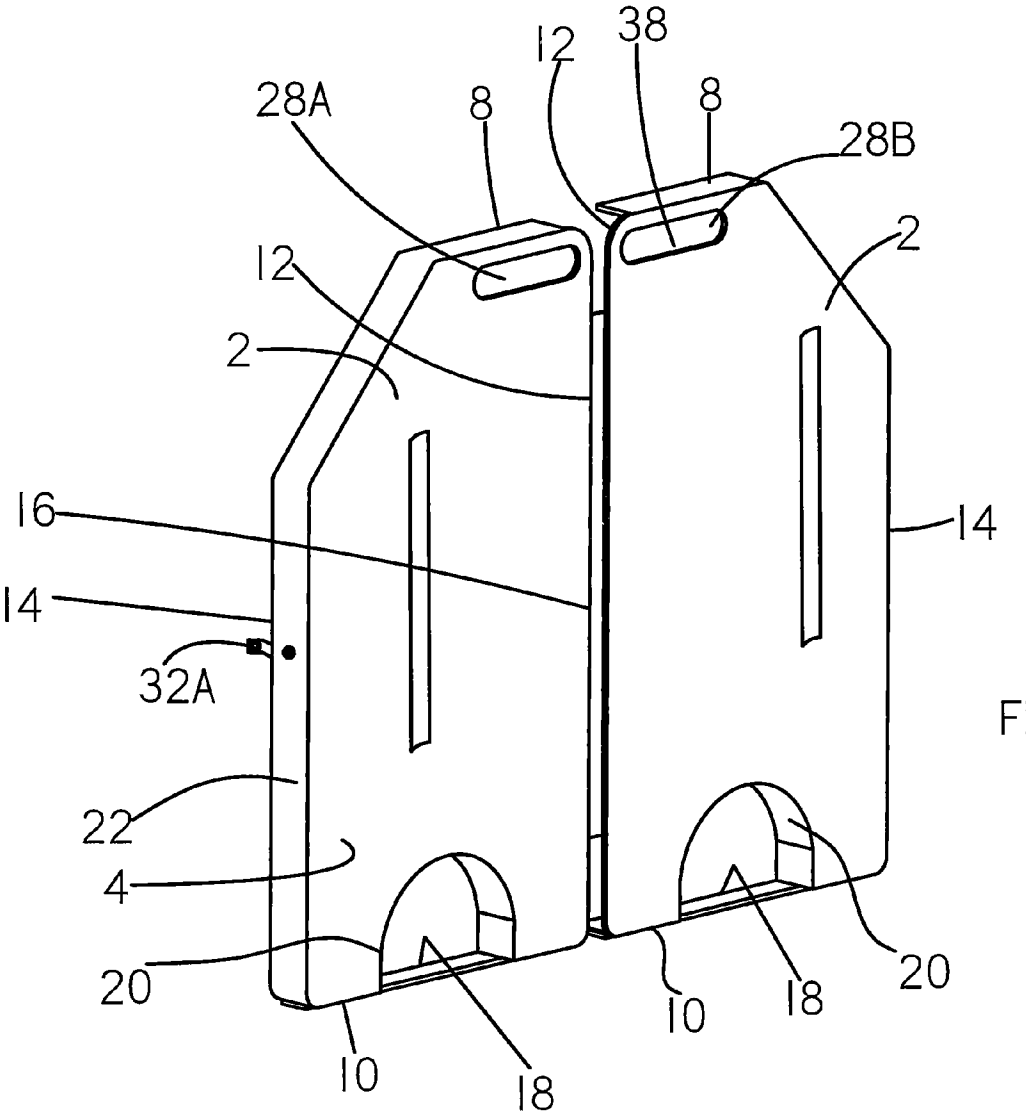
FIG. 1 shows a front view of a foldable embodiment of the present invention in an open position.
Figure 2:
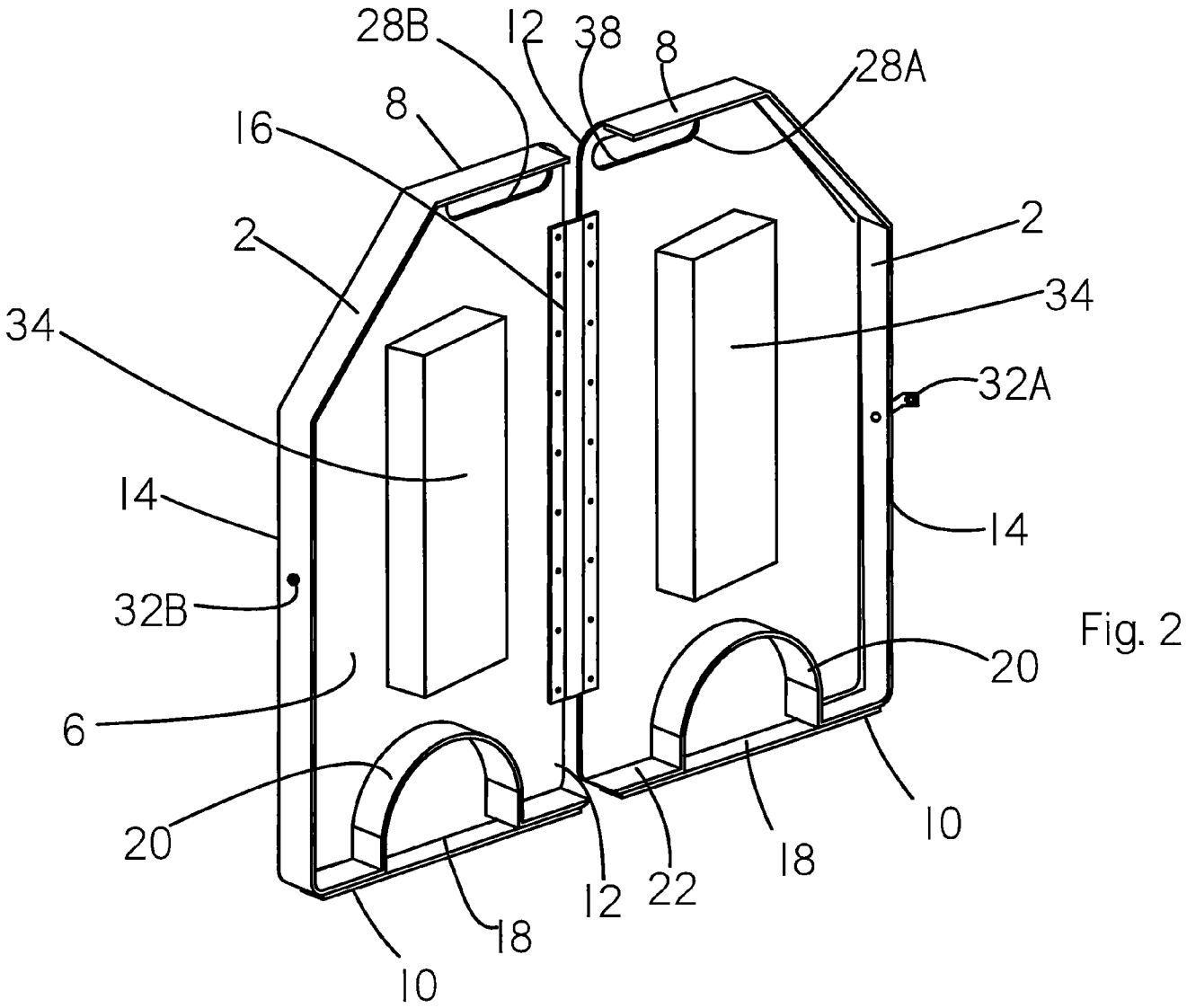
FIG. 2 shows a rear view of the embodiment of FIG. 1 in an open position.

FIGS. 1-5 will be used as reference to describe certain embodiments of the present invention. FIGS. 1-5 are illustrative in nature and are not meant to the limit the present invention to the embodiments illustrated.

Embodiments of the present invention provide a device for protecting the lower body while catching warm-up pitches from a seated position. Although this disclosure refers to use of the device with baseball or softball pitching, it will be readily understood that it is equally applicable to other sports or activities which may require protection of the lower body while in a seated position.

In one embodiment (FIG. 1), the device is an upright structure comprising two substantially rigid panels 2. Each panel 2 has a front surface 4 which faces the pitcher, and a rear surface 6 which faces the user. Each panel 2 has an upper edge 8, lower edge 10, inner edge 12, and an outer edge 14. The two panels 2 are joined along their inner edges 12 by a hinge-region 16 that allows the panels 2 to be pivoted into an open position for use, or a closed position for transport. In one embodiment, when the two panels 2 are pivoted into the closed position, the front surfaces 4 of the panels 2 will be in proximity and face each other.

It will be appreciated that while the features of the device are described herein with respect to two pivotally attached panels 2, the device may equally be constructed from a single substantially rigid panel or more than two foldable panels. Optionally, in another embodiment, the single panel may contain a centrally disposed vertical hinge-like region 16 which allows the panel to be folded in half. In this manner, a single panel may function similarly to the two panel design described more fully hereafter.

It will be appreciated that the shape of the device is not limited to those shown in the embodiments herein. Any shape may be used so long as it confers protection on the lower portion of the user's body when placed between the user and a pitcher. It also will be appreciated that the device is not limited to rigid materials. The device may be constructed of a resilient material with a thickness or stiffness sufficient to protect the user from ball strikes. In an embodiment where the device comprises a resilient material, it may be possible to roll the device for transport in addition to folding as described for embodiments utilizing one or more rigid panels 2.

Figure 4:
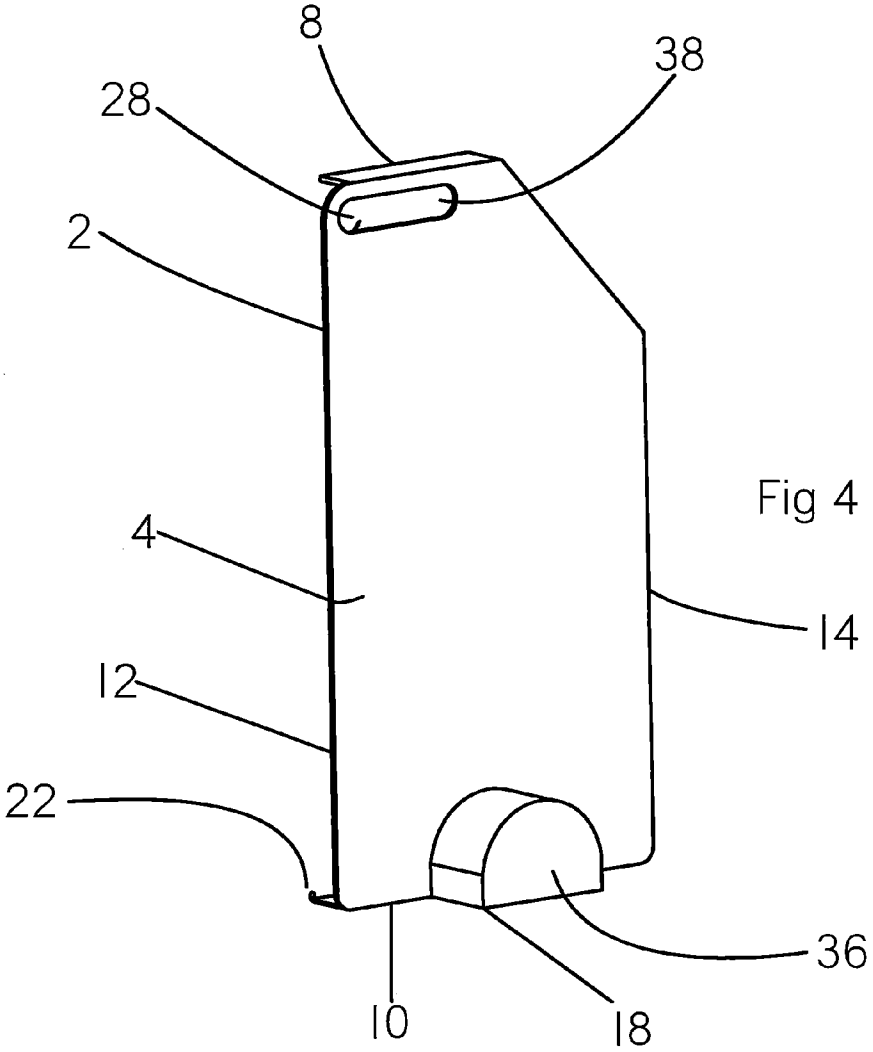
FIG. 4 shows a front view of one panel of an alternative embodiment.
Figure 5:
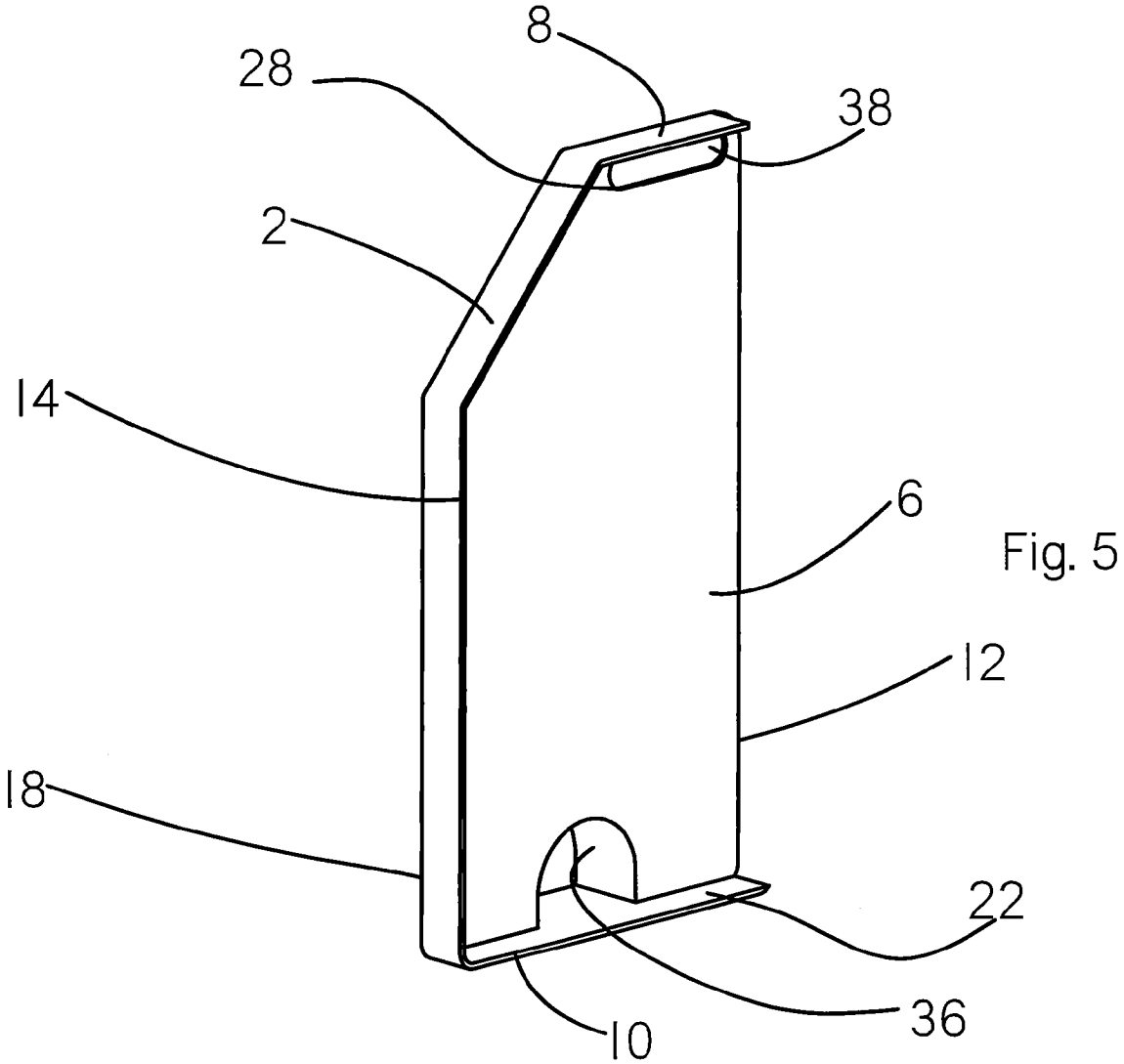
FIG. 5 shows a rear view of the embodiment of FIG. 4.

In one embodiment, the device has a foot plate 18 located at the lower edge 10 of each panel 2. In some embodiments, the foot plate is beneath a curved or arched opening 20 in the lower edge of each panel. In other embodiments, the foot plate 18 may include other forms, such as the lower wall of an enclosed half-cylinder cup 36 into which the user's foot may be placed (FIGS. 4-5). It will be appreciated that the foot plate 18 may take many forms or shapes, whether as a projection from the lower edge of the panel 2 (FIGS. 6-7), or the bottom surface of an enclosed space molded into the panel 2, so long as a user may place his foot on the foot plate 18 and stabilize the device by applying downward force with his feet. Nor must the foot plate 18 be flat. The foot plate 18 may include molded contours, padding, friction-creating material (such as a rough texture, short raised polymer knobs, ribs, stubs or the like) or other means to receive or accommodate a user's foot.

While in use, and being struck by an oncoming baseball, the device may be held in an upright position by a combination of the user's feet on the foot plates 18, and other physical means. In some embodiments, the physical means themselves may be sufficient to hold the device upright while the user's feet are not engaged in the foot plates 18, for example when the user is fetching a stray ball.

In one embodiment (FIG. 1), the edge of each panel 2 is surrounded by a flange 22 that creates an edge of sufficient width to allow the device to remain in an upright position when the device is fully opened. The user's feet further reinforce the upright position by applying downward force when they are placed in the foot plates 18. In another embodiment, the device is maintained in the upright position by a portion of flange 22 located along the lower edge 10 of the panel 2 having extensions to both to the front and rear of the panel 2. The flange 22 may be extended outward toward the user's position along portions of the lower edge 10 to create foot plates 18 for receiving the feet of the user to stabilize the device while it is in use.

Figure 6:
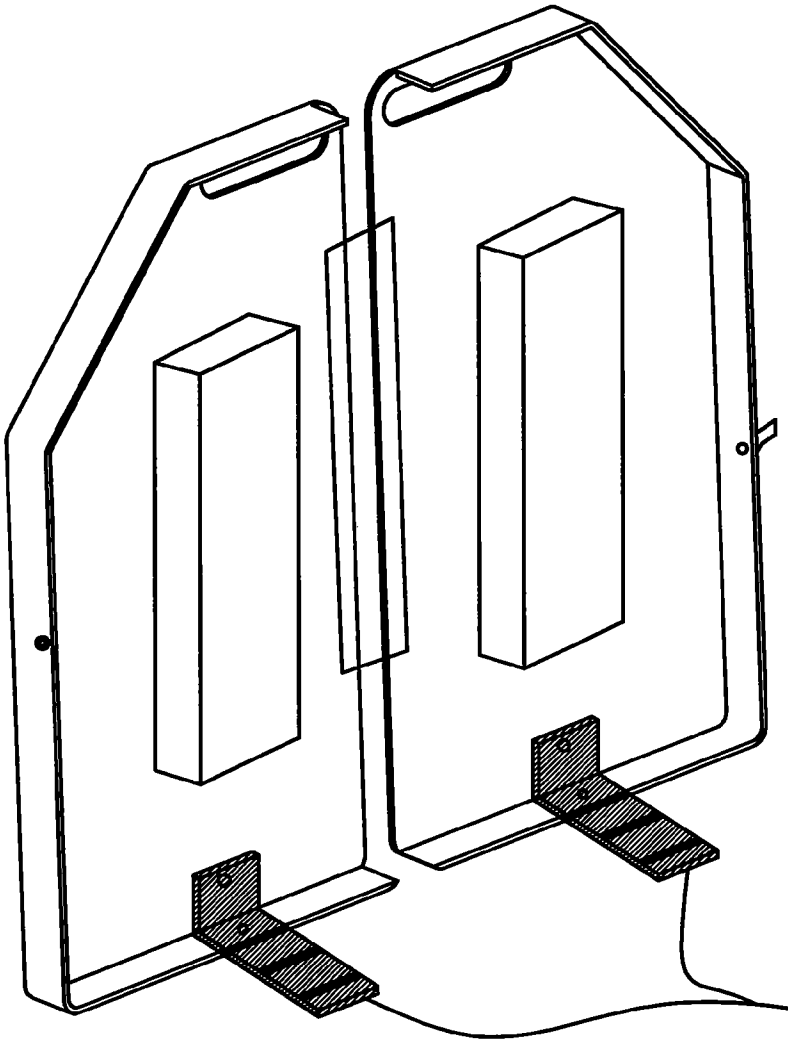
FIG. 6 shows a rear view of an alternative embodiment of the present invention, using an L-bracket for a foot plate.

In another embodiment shown in FIG. 6, the panel 2 may include one or more L-brackets 24 attached at the lower edge 10 of the panel 2, which may at least partially assist in holding the device in an upright position. L-brackets 24 may be located at any convenient position along the bottom edge 6 of the panel 2, and in a preferred embodiment serve as foot plates where the user may conveniently place his feet to stabilize the device.

Figure 7:
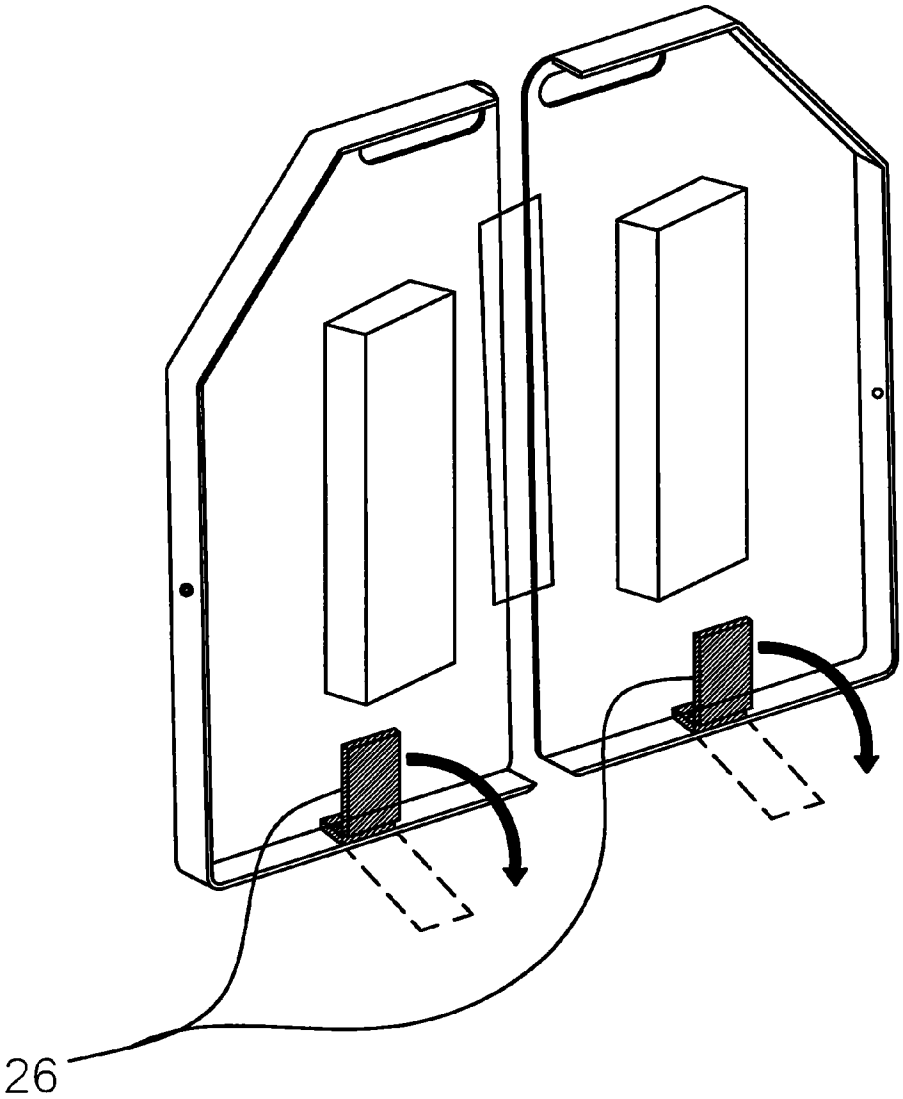
FIG. 7 shows a rear view of yet another alternative embodiment of the present invention, using a foldable tab for a foot plate.

In another embodiment shown in FIG. 7, the panel 2 may include one or more pivotable hinged tabs 26 located at the lower edge 10 of the panel 2, which may at least partially assist in holding the device in an upright position. When in use, the tab 26 may be pivoted downward from the panel 2 such that it is in contact with the ground. When the tab 26 is not in use, it may be pivoted to a position where it rests against the panel 2 for easy transport. The tab 26 may be located at any convenient position along the bottom edge 6 of the panel 2, and in a preferred embodiment serve as the foot plate where the user may conveniently place his feet to stabilize the device.

It will be appreciated that in an embodiment comprising an enclosed half-cylinder 36 comprising a foot plate, such as shown in FIGS. 4-5, which may protrude from the surface of the device, the device may either be a single panel which cannot pivot into a closed position, or the hinge region 16 of the hinged single panel or two-panel device must allow it to pivot such that the two rear surfaces 6 face when the device is in the closed position.

In one embodiment, the device further comprises a handle 28 located proximate to the upper edge 8 of at least one panel 2. The handle 28 may comprise an elongated indention or aperture 12 in each panel 2. In one embodiment, a handle 28A/B is arranged on each panel 2 such that when the device is in its closed position, the handles 28A/B align to form a single handle structure 28 which allows the user to place a hand through both panels 2. It will be appreciated that other handle 28 mechanisms as known in the art may be used. In one embodiment, the handle 28 may comprise one or more straps 30 affixed to the upper edge 8 of the panel 2. In another embodiment, the handle 28 may be located proximate to the outer edge 14, such that when being transported by the handle 28 the device is rotated 90-degrees from its upright position.

Figure 3:
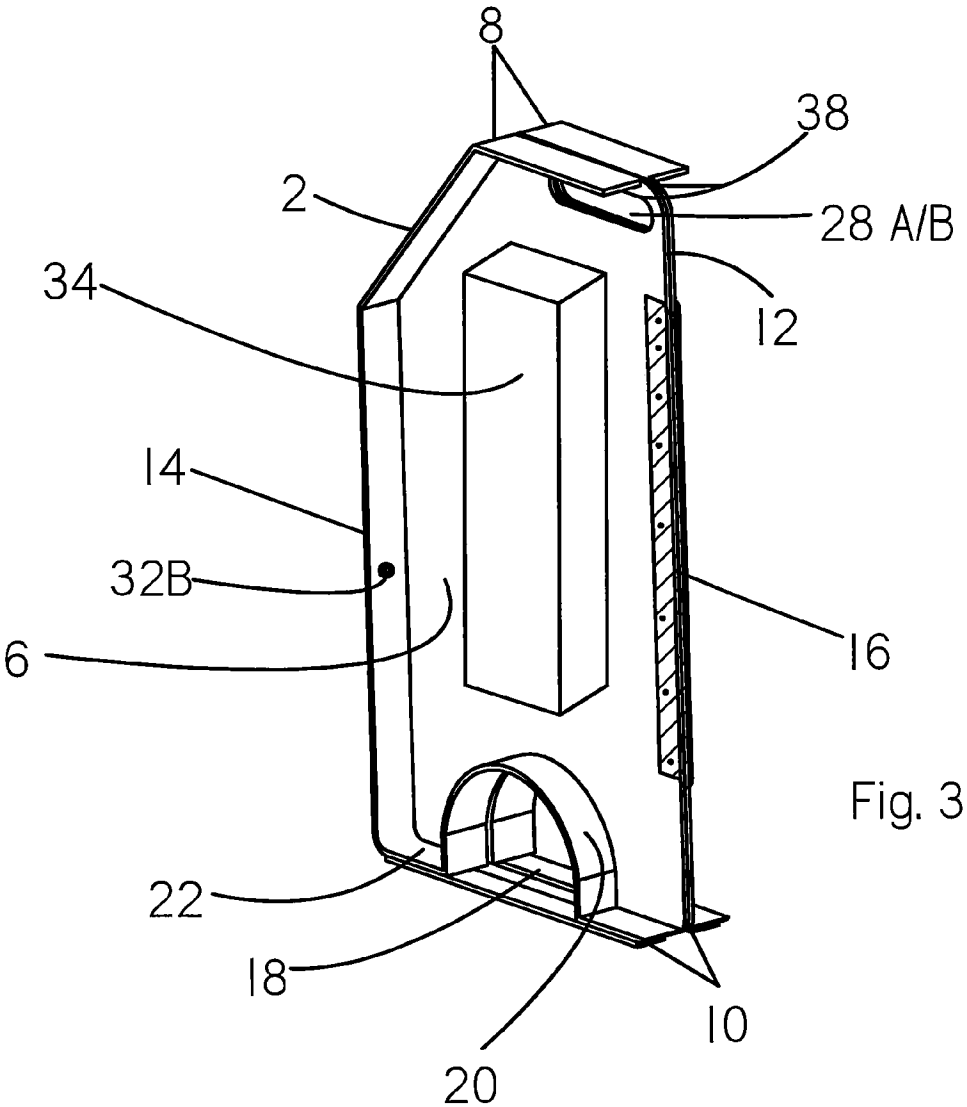
FIG. 3 shows a view of the embodiment of FIG. 1 in a folded position.

In one embodiment, the device further comprises a reversible mating element 32 for holding the device in a folded position. Reversible mating elements include, but are not limited to latches, hooks, or hook/loop fasteners, for example Velcro. Other reversible mating elements may be used as is known in the art. One mating element 32A may be located on the outer edge 14A of the first panel 2, and the complementary mating element 32B may be located on the outer edge 14B of the second panel 2. When the two panels 2 are pivoted closed, the mating elements 32A/B are brought into proximity and may be engaged thereby securing the device in a closed position for transport (FIG. 3).

In one embodiment (FIG. 2), the device comprises one or more cushioning pads 34 on the rear surface 6 of the panel 2. The cushioning pads 34 may be positioned such that they align with the front of a user's legs while in the seated position. In this manner, the cushioning pads 34 will dissipate the impact energy from balls striking the front surface 4 of the device and prevent injury or discomfort to the user.

The device as described herein may be used to protect the lower portion of the body from stray balls when the user is in a seated position. In one embodiment of using the device described herein, a user will transport the device to the desired location, generally a baseball field or practice field. The user will take up his preferred seated position, and prepare the device for use by disengaging the reversible mating elements 32 and pivoting the two panels 2 into the open position. He will then position the device between himself and the pitcher with the rear surface 6 of the device facing toward him. If necessary, the pivoting tabs 26 may be lowered into position to stabilize the device. The user will brace his legs against the cushioning pads 34 and position his feet on the foot plates 18. In this manner, his legs and groin are protected from stray balls. In the event a ball goes further afield and he needs to rise to fetch it, the user may quickly and easily remove his feet from the foot plates 18. In some embodiments, the flange 22, L-bracket 24, or tab 26 may maintain the device in the upright position while he is away to fetch the ball, and will allow a quick repositioning when he returns. When the warm-up is over, he may reverse the steps to return the device to its folded position for easy transport.

Although the present invention has been described and shown with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A protective sporting good device, comprising:

a. a panel having a front surface and a rear surface and an upper portion and a lower portion and a lower edge and an upper edge and an inner edge and an outer edge;

b. a foot plate positioned near the lower edge adapted for receiving a user's foot, wherein while in use, the device is stabilized in a substantially upright orientation at least partially by the user placing his foot on the foot plate;

c. wherein said panel is a first panel, and further comprising a second panel having an inner edge, the first and second panels being pivotally attached at the inner edge of the first panel and the inner edge of the second panel.

2. The device of claim 1, wherein the device further comprises a reversible mating element on the outer edge of the first panel and complementary mating element on the outer edge of the second panel.

3. A protective sporting good device, comprising:

a. a panel having a front surface and a rear surface and an upper portion and a lower portion and a lower edge and an upper edge and an inner edge and an outer edge;

b. a foot plate positioned near the lower edge adapted for receiving a user's foot, wherein while in use, the device is stabilized in a substantially upright orientation at least partially by the user placing his foot on the foot plate;

c. wherein the panel comprises an arched opening located at the lower edge of the panel and the foot plate extends across said arched opening.

4. A protective sporting good device, comprising:

a. a panel having a front surface and a rear surface and an upper portion and a lower portion and a lower edge and an upper edge and an inner edge and an outer edge;

b. a foot plate positioned near the lower edge adapted for receiving a user's foot, wherein while in use, the device is stabilized in a substantially upright orientation at least partially by the user placing his foot on the foot plate;

c. wherein near the lower edge said front and rear surfaces extend forwardly forming an enclosure for receiving the user's foot, said foot plate being a lower surface of said enclosure.

5. A protective sporting good device, comprising:

a. a panel having a front surface and a rear surface and an upper portion and a lower portion and a lower edge and an upper edge and an inner edge and an outer edge;

b. a means for receiving the feet of an individual, wherein engagement of the individual's feet with said means at least partially stabilizes the device in an upright position;

c. wherein said panel comprises an arched opening located at the lower edge of the panel and the said means comprises a foot plate extending across said arched opening.

6. A protective sporting good device, comprising:

a. a panel having a front surface and a rear surface and an upper portion and a lower portion and a lower edge and an upper edge and an inner edge and an outer edge;

b. a means for receiving the feet of an individual, wherein engagement of the individual's feet with said means at least partially stabilizes the device in an upright position;

c. wherein said means is an enclosure, wherein near the lower edge said front and rear surfaces extend forwardly forming said enclosure.

7. A protective sporting good device, comprising:

a. a panel having a front surface and a rear surface and an upper portion and a lower portion and a lower edge and an upper edge and an inner edge and an outer edge, and an arched opening located at the lower edge of the panel;

b. a foot plate extending across said arched opening;

c. wherein said panel is a first panel, and further comprising a second panel that is substantially a mirror image of said first panel and having an inner edge, said first and second panel being pivotally attached at each of the inner edges.

8. The device of claim 7, further comprising a cushioning pad on the rear surface of at least the first panel.

9. The device of claim 8, wherein said device comprises a flange along at least a portion of the lower edge of at least said first panel, wherein said flange allows said device to be free standing.

* * * * *